US012104308B2

(12) United States Patent
Duarte

(10) Patent No.: US 12,104,308 B2
(45) Date of Patent: Oct. 1, 2024

(54) COLLAPSIBLE AGITATOR ASSEMBLY

(71) Applicant: Tania Duarte, Pasadena, CA (US)

(72) Inventor: Tania Duarte, Pasadena, CA (US)

( * ) Notice: Subject to any disclaimer, the term of this patent is extended or adjusted under 35 U.S.C. 154(b) by 475 days.

(21) Appl. No.: 17/487,917

(22) Filed: Sep. 28, 2021

(65) Prior Publication Data

US 2023/0098539 A1 Mar. 30, 2023

(51) Int. Cl.

| | |
|---|---|
| ***D06F 13/06*** | (2006.01) |
| ***D06F 37/12*** | (2006.01) |
| ***D06F 37/26*** | (2006.01) |
| ***D06F 37/40*** | (2006.01) |

(52) U.S. Cl.
CPC ..... *D06F 37/12* (2013.01); *D06F 37/267* (2013.01); *D06F 37/40* (2013.01)

(58) Field of Classification Search
CPC ..... D06F 13/00; D06F 13/02; D06F 13/04; D06F 13/06; D06F 17/06; D06F 17/10; D06F 21/06; D06F 21/08; D06F 23/04
See application file for complete search history.

(56) References Cited

U.S. PATENT DOCUMENTS

| | | | | |
|---|---|---|---|---|
| 4,170,882 | A | | 10/1979 | Brenner |
| 4,193,275 | A | | 3/1980 | Bochan |
| 4,325,234 | A | | 4/1982 | Toma |
| 4,920,770 | A | | 5/1990 | Dooley |
| D314,263 | S | | 1/1991 | Mueller |
| 5,473,915 | A | | 12/1995 | Hur |
| 5,675,996 | A | * | 10/1997 | Cho ..... D06F 17/10 68/134 |
| 5,765,405 | A | | 6/1998 | Jung |

* cited by examiner

*Primary Examiner* — David G Cormier

(57) ABSTRACT

A collapsible agitator assembly includes an impeller that is attachable to a drive shaft of a washing machine to rotate clothing in the washing machine for washing. A first agitator tube is attachable to the drive shaft of the washing machine to agitate water in the washing machine for washing. The first agitator tube is retractable into the impeller. A bushing extends upwardly through the first agitator tube. A second agitator tube is attachable to the bushing and the second agitator tube is retractable inside of the first agitator tube to accommodate a small load of laundry. The second agitator tube is extendable upwardly from the first agitator tube to accommodate a large load of laundry.

3 Claims, 5 Drawing Sheets

COLLAPSIBLE AGITATOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to agitator devices and more particularly pertains to a new agitator device for facilitating a washing machine to accommodate various sizes of loads. The device includes an impeller, a first agitator tube that can be recessed into the impeller and a second agitator tube that can be recessed into the first agitator tube. Each of the first agitator tube and the second agitator tube can be fully extended upwardly from the impeller. In this way the first agitator tube and the second agitator tube can accommodate a maximum load of laundry or a minimum load of laundry.

(2) Description of Related Art Including Information Disclosed Under 37 CFR 1.97 and 1.98

The prior art relates to agitator devices including a washing machine impeller having adjustable vanes. The prior art discloses an agitator post device that includes a center post which threadably engages an outer sleeve. The prior art discloses a variety of washing machine agitators that each includes a first element which oscillates in a first direction and a second element which oscillates in a second direction. The prior art discloses a variety of washing machine agitators that each includes a first portion which has a degree of oscillation that is less that a degree of oscillation of a second portion. The prior art discloses a telescopically adjustable washing machine agitator that is adjusted by buoyancy in water.

BRIEF SUMMARY OF THE INVENTION

An embodiment of the disclosure meets the needs presented above by generally comprising an impeller that is attachable to a drive shaft of a washing machine to rotate clothing in the washing machine for washing. A first agitator tube is attachable to the drive shaft of the washing machine to agitate water in the washing machine for washing. The first agitator tube is retractable into the impeller. A bushing extends upwardly through the first agitator tube. A second agitator tube is attachable to the bushing and the second agitator tube is retractable inside of the first agitator tube to accommodate a small load of laundry. The second agitator tube is extendable upwardly from the first agitator tube to accommodate a large load of laundry.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
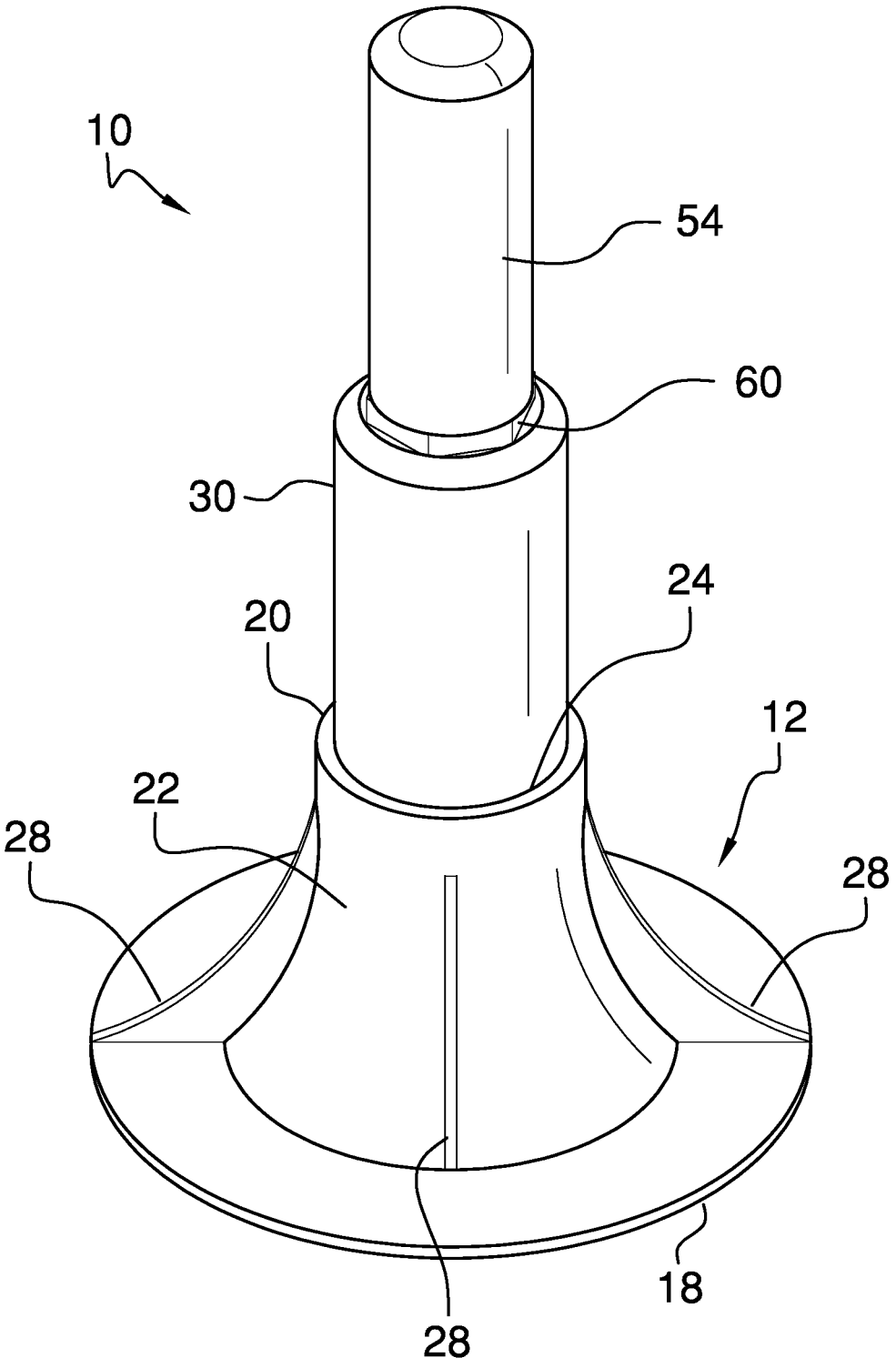
FIG. 1 is a top perspective view of a collapsible agitator assembly according to an embodiment of the disclosure.
Figure 2:
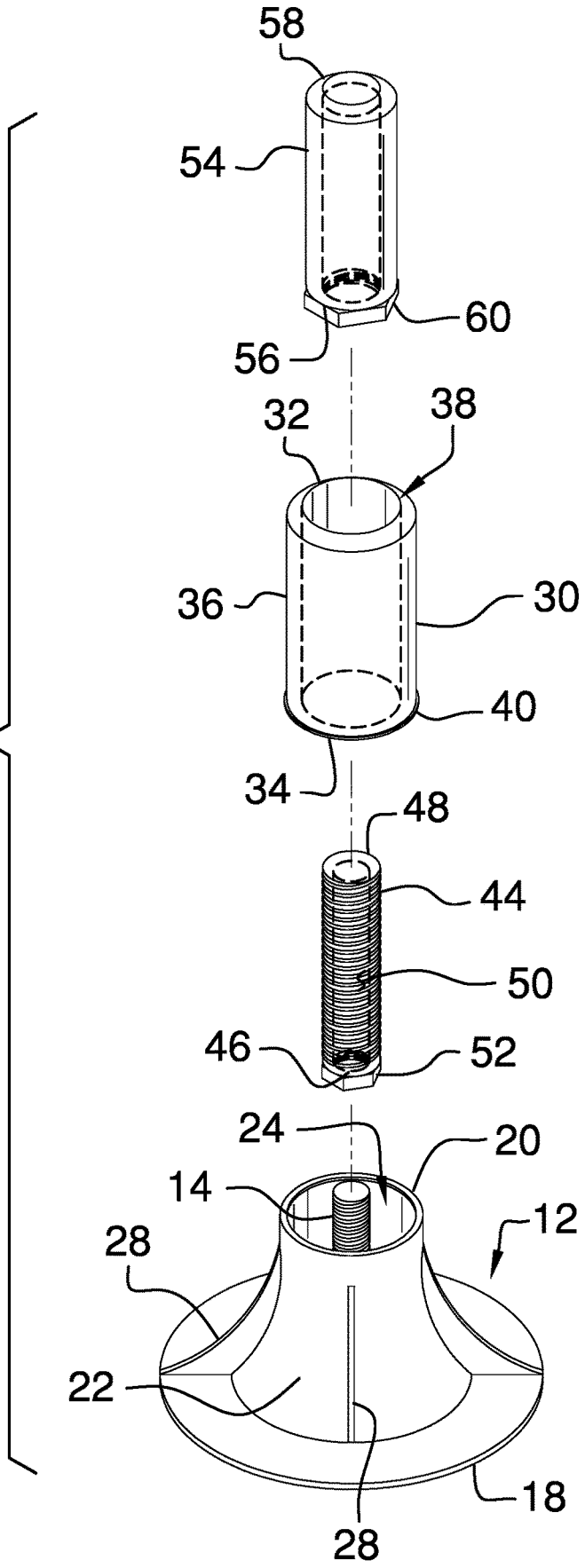
FIG. 2 is an exploded perspective view of an embodiment of the disclosure.
Figure 3:
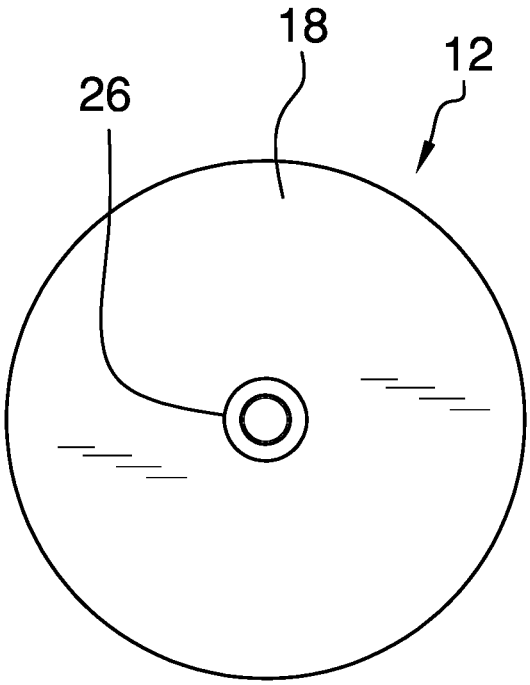
FIG. 3 is a bottom view of an embodiment of the disclosure.
Figure 4:
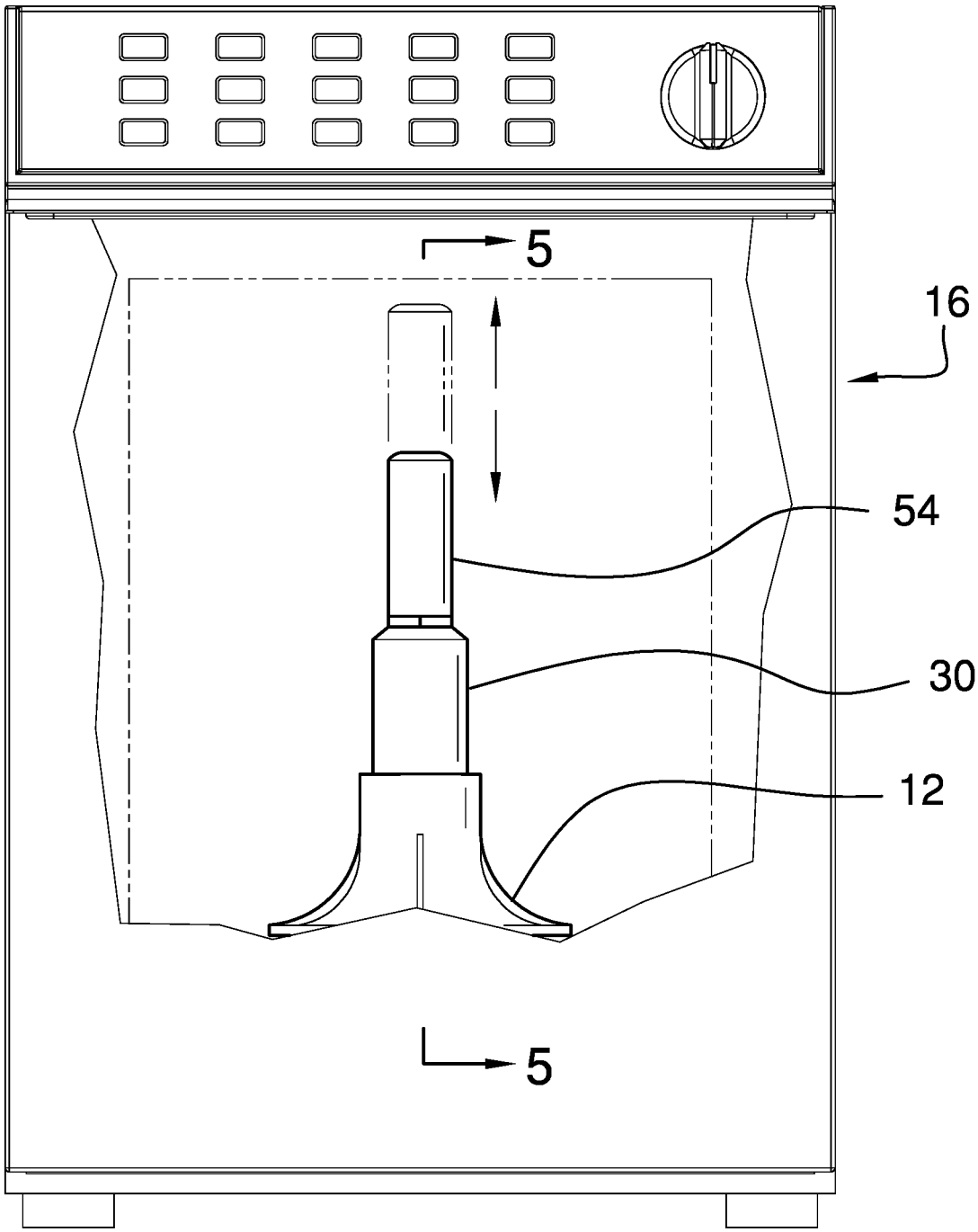
FIG. 4 is a cut-away in-use view of an embodiment of the disclosure.
Figure 5:
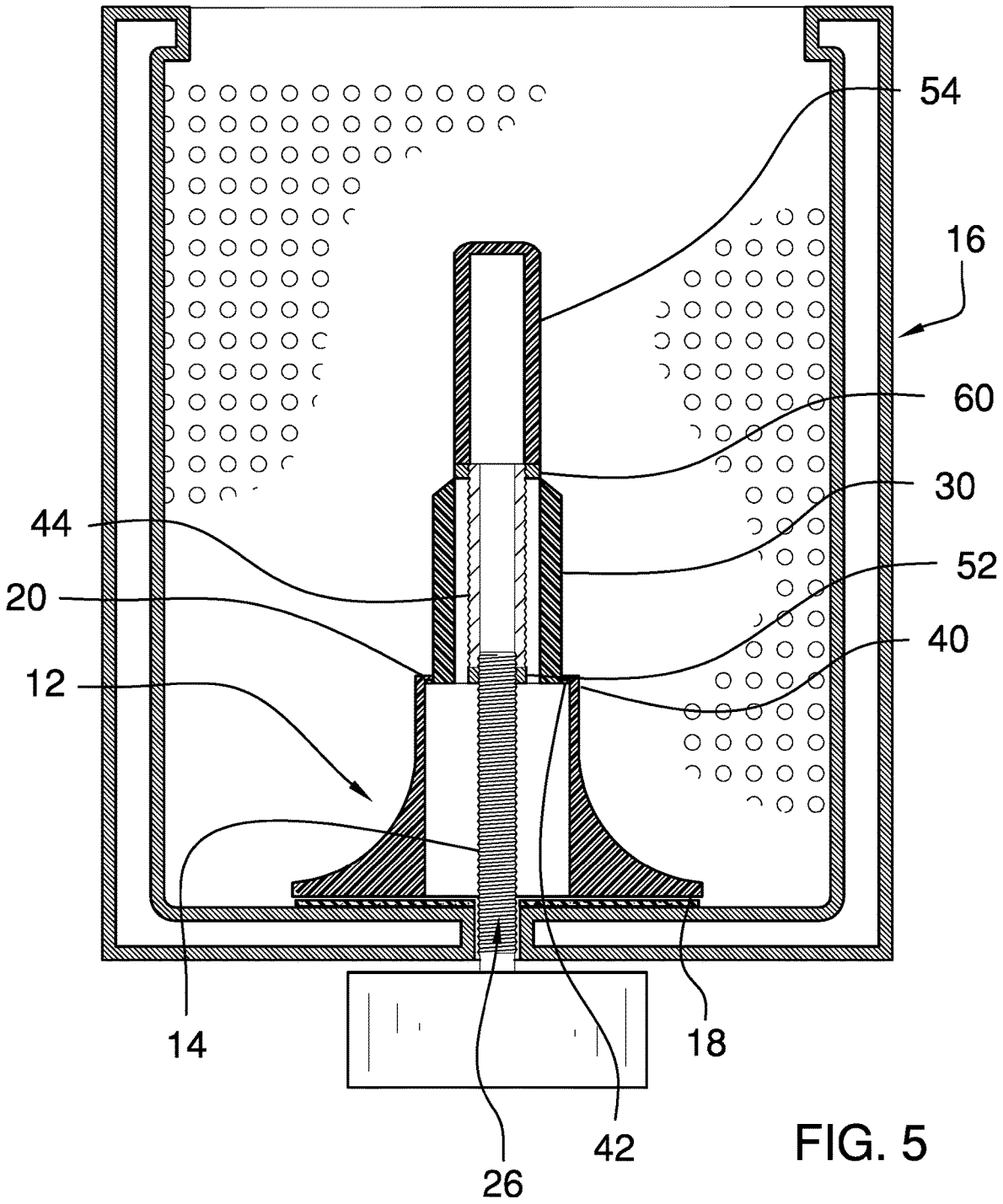
FIG. 5 is a cross sectional view taken along line 5-5 of FIG. 4 of an embodiment of the disclosure.

With reference now to the drawings, and in particular to FIGS. 1 through 5 thereof, a new agitator device embodying the principles and concepts of an embodiment of the disclosure and generally designated by the reference numeral 10 will be described.

As best illustrated in FIGS. 1 through 5, the collapsible agitator assembly 10 generally comprises an impeller 12 that is attachable to a drive shaft 14 of a washing machine 16 to rotate laundry in the washing machine 16 for washing. The washing machine 16 may be an electronic washing machine of any conventional design that might commonly be found in a home. The impeller 12 has a bottom end 18, a top end 20 and an outer wall 22 extending between the top end 20 and the bottom end 18. The outer wall 22 is continuously arcuate about an axis extending between the top end 20 and the bottom end 18 such that the impeller 12 has a cylindrical shape. Furthermore, the outer wall 22 slopes outwardly between the top end 20 and the bottom end 18 such that the top end 20 has a diameter that is less than a diameter of the bottom end 18.

The impeller 12 is substantially hollow, the top end 20 has a top opening 24 extending into an interior of the impeller 12 and the bottom end 18 has a bottom opening 26 extending into the interior of the impeller 12. The outer wall 22 has a plurality of ribs 28 each extending outwardly from the outer wall 22. Each of the ribs 28 extends between the top end 20 and the bottom end 18. Additionally, the ribs 28 are spaced apart from each other and are distributed around the outer wall 22.

A first agitator tube 30 is attachable to the drive shaft 14 of the washing machine 16 to agitate water in the washing machine 16 for washing laundry. The first agitator tube 30 extends upwardly from the impeller 12, and the first agitator tube 30 has an upper end 32, a lower end 34 and an outside wall 36 extending between the upper end 32 and the lower end 34. The outside wall 36 has a tapered section 38 extending from the upper end 32 toward the lower end 34. Additionally, the outside wall 36 has a lip 40 extending around a full circumference of the outside wall 36, and the lip 40 is aligned with the lower end 34. The first agitator tube 30 extends into the top opening 24 in the top end 20 of the impeller 12. The lip 40 abuts a lower surface 42 of the top end 20 of the impeller 12 thereby inhibiting the first agitator tube 30 from being removed from the top opening 24. The first agitator tube 30 is retractable into the impeller 12.

A bushing 44 is threadably attachable to the drive shaft 14 of the washing machine 16 such that the bushing 44 extends upwardly through the first agitator tube 30. The bushing 44 has a bottom end 46, a top end 48 and an outer surface 50 extending between the top end 48 and the bottom end 46, and the outer surface 50 is threaded. The bushing 44 may have a length ranging between approximately 6.0 inches and 12.0 inches. A first nut 52 is attached to the bottom end 46 of the bushing 44. The first nut 52 threadably engages the drive shaft 14 of the washing machine 16 such that the bushing 44 is oriented to extend along an axis is oriented collinear with a longitudinal axis of the drive shaft 14 when the first nut 52 is threaded onto the drive shaft 14. Additionally, the first nut 52 may comprise a threaded nut commonly associated with a nut and bolt fastener. The outside wall 36 of the first agitator tube 30 engages the first nut 52 such that the first agitator tube 30 moves upwardly and downwardly with the bushing 44. In this way the first agitator tube 30 is recessed into the impeller 12 when the first nut 52 is threaded downwardly on the drive shaft 14.

A second agitator tube 54 is provided and the second agitator tube 54 is attachable to the bushing 44. The second agitator tube 54 has a diameter that is less than a diameter of the first agitator tube 30. Thus, the second agitator tube 54 is positionable in a retracted position having the second agitator tube 54 being positioned inside of the first agitator tube 30. In this way the second agitator tube 54 accommodates a small load of laundry. Conversely, the second agitator tube 54 is positionable in an extended position having the second agitator tube 54 extending upwardly from the first agitator tube 30. In this way the second agitator tube 54 can accommodate a large load of laundry.

The second agitator tube 54 has a lower end 56 and an upper end 58, and a second nut 60 is attached to the lower end 56 of the second agitator tube 54. The second nut 60 threadably engages the outer surface 50 of the bushing 44. Moreover, the bushing 44 extends upwardly into the second agitator tube 54 when the second nut 60 is threaded downwardly on the bushing 44. In this way the second agitator tube 54 is urged into the retracted position having the upper end 58 of the second agitator tube 54 being positioned proximate the upper end 32 of the first agitator tube 30. The second nut 60 is positioned proximate the top end 48 of the bushing 44 when the second nut 60 is threaded upwardly on the bushing 44. In this way the second agitator tube 54 is urged into the extended position having the upper end 58 of the second agitator tube 54 being spaced upwardly from the upper end 32 of the first agitator tube 30.

In use, each of the first agitator tube 30 and the second agitator tube 54 are rotated to thread the first nut 52 or the second nut 60 upwardly or downwardly, depending on the direction of rotation. In this way each of the first agitator tube 30 and the second agitator tube 54 can be extended into the extended position. Thus, the first agitator tube 30 and the second agitator tube 54 accommodate a maximum size load of laundry. Conversely, the first agitator tube 30 and the second agitator tube 54 can be retracted downwardly into the impeller 12. In this way the first agitator tube 30 and the second agitator tube 54 accommodate a minimum size load of laundry.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A collapsible agitator assembly for a washing machine having an adjustable height, said assembly comprising:

an impeller being attachable to a drive shaft of a washing machine wherein said impeller is configured to rotate clothing in the washing machine for washing;

a first agitator tube being attachable to the drive shaft of the washing machine wherein said first agitator tube is configured to agitate water in the washing machine for washing, said first agitator tube extending upwardly from said impeller, said first agitator tube being retractable into said impeller;

a bushing being threadably attachable to the drive shaft of the washing machine such that said bushing extends upwardly through said first agitator tube; and a second agitator tube being attachable to said bushing, said second agitator tube having a diameter being less than a diameter of said first agitator tube, said second agitator tube being positionable in a retracted position having said second agitator tube being positioned inside of said first agitator tube wherein said second agitator tube is configured to accommodate a small load of laundry, said second agitator tube being positionable in an extended position having said second agitator tube extending upwardly from said first agitator tube wherein said second agitator tube is configured to accommodate a large load of laundry.

2. The assembly according to claim 1, wherein:

said impeller has a bottom end, a top end and an outer wall extending between said top end and said bottom end, said outer wall sloping outwardly between said top end and said bottom end such that said top end has a diameter being less than a diameter of said bottom end, said impeller being substantially hollow;

said top end has a top opening extending into an interior of said impeller;

said bottom end has a bottom opening extending into said interior of said impeller; and said outer wall has a plurality of ribs each extending outwardly from said outer wall, each of said ribs extending between said top end and said bottom end, said ribs being spaced apart from each other and being distributed around said outer wall.

3. The assembly according to claim 2, wherein:

said first agitator tube has an upper end, a lower end and an outside wall extending between said upper end and said lower end;

said outside wall has a tapered section extending from said upper end toward said lower end;

said outside wall has a lip extending around a full circumference of said outside wall, said lip being aligned with said lower end; and said first agitator tube extends into said top opening in said top end of said impeller, said lip abutting a lower surface of a top wall of said impeller thereby inhibiting said first agitator tube from being removed from said top opening.

* * * * *